United States Patent [19]

Shu

[11] Patent Number: 4,612,990

[45] Date of Patent: Sep. 23, 1986

[54] METHOD FOR DIVERTING STEAM IN THERMAL RECOVERY PROCESS

[75] Inventor: Winston R. Shu, Dallas, Tex.

[73] Assignee: Mobil Oil Corporation, New York, N.Y.

[21] Appl. No.: 681,343

[22] Filed: Dec. 13, 1984

Related U.S. Application Data

[63] Continuation-in-part of Ser. No. 518,993, Aug. 1, 1983, abandoned.

[51] Int. Cl.[4] ..... E21B 43/24

[52] U.S. Cl. ..... 166/272; 166/303

[58] Field of Search ..... 166/272, 274, 288, 303

[56] References Cited

U.S. PATENT DOCUMENTS

| | | | |
|---|---|---|---|
| 4,006,778 | 2/1977 | Redford et al. | 166/261 |
| 4,046,195 | 9/1977 | Cram et al. | 166/272 |
| 4,088,188 | 5/1978 | Widmyer | 166/303 |
| 4,166,504 | 9/1979 | Brown et al. | 166/272 |

*Primary Examiner*—James A. Leppink

*Assistant Examiner*—William P. Neuder

*Attorney, Agent, or Firm*—Alexander J. McKillop; Michael G. Gilman; Charles A. Malone

[57] ABSTRACT

The sweep efficiency of a steam flooding process is improved by injecting steam into the lower portion of the formation through an injection well until steam channeling or steam overriding has occurred, after which steam injection is terminated and an oxygen-containing gas such as air, oxygen-enriched air, or oxygen is injected into the formation to oxidize the residual oil in the portion of the formation where steam override or channeling has occurred. This forms an asphaltic material that decreases the permeability of that zone. Thereafter, steam injection is resumed and as a consequence of the oxidized asphaltic material plug, the steam moves into portions of the formation to mobilize viscous oil not swept by the initial injection of steam. During injection of the oxygen-containing gas production of oil may be terminated or continued. Multiple cycles of steam and oxygen-containing gas injection may be applied to a formation to better control sweep efficiency.

21 Claims, 3 Drawing Figures

METHOD FOR DIVERTING STEAM IN THERMAL RECOVERY PROCESS

CROSS REFERENCE TO RELATED APPLICATIONS

This application is a continuation-in-part of my application Ser. No. 518,993, filed Aug. 1, 1983, now abandoned.

FIELD OF THE INVENTION

This invention relates to a thermal oil recovery process employing steam flooding in which the sweep efficiency of the steam is improved significantly by alternately injecting steam and an oxygen-containing gas to form a viscous asphaltic material by oxidation of residual oil in the steam swept zones in the formation.

BACKGROUND OF THE INVENTION

In thermal recovery processes for heavy oil production employing steam flooding, channeling and override problems are common. Channeling is due to the high mobility ratio of the displacing fluid (steam) and the low mobility of the displaced fluid (heavy oil). It can also be caused by high permeability zones (theif zones) which could exist in the reservoir. The override effect occurs because of the density difference between the steam and the oil. When either of these phenomena occurs, steam tends to break through early at the production wells and bypass a considerable volume of the reservoir.

Currently there is no proven technology to prevent steam channeling and override. Efforts have been concentrated on developing a good surfactant chemical for coinjection with steam. The surfactant is intended to foam in-situ, thus reducing steam mobility and blocking thief zones. These surfactant chemicals, however, are costly and subjected to degradation due to high temperatures and reservoir pH changes (Al-Khafaji et al, SPE Paper No. 10777, presented at 1982 SPE California Regional Meeting, San Francisco, Mar. 24–26, 1982).

SUMMARY OF THE INVENTION

It has now been found that the sweep efficiency in a steam flooding process may be improved by injecting an oxygen-containing gas into steam-swept channels so as to oxidize the residual oil and form a viscous asphaltic material. This material reduces the permeability for the steam-swept channels and so enables the subsequently injected steam to migrate into additional portions of the formation containing unswept oil.

According to the present invention, therefore, an improved steam flooding process for recovering viscous oil from a subterranean formation utilizes a permeability-reducing technique to control sweep efficiency during steam flooing. A subterranean, viscous oil-containing formation is penetrated by at least one injection well and at least one production well which is spaced from the injection well by a horizontal distance or offset. The injection well is preferably in fluid communication with the lower one-third to one-half of the vertical thickness of the formation and the prouduction well is in fluid communication with a substantial portion of the formation. Initially, steam is injected into the lower portion of the formation through the injection well and fluids including oil, are recovered from the formation through the production well thereby forming a steam-swept zone.

Steam injection is continued until the fluid recovered contains a predetermined amount of steam or water, alternatively, or steam injection may be terminated prior to steam breakthrough. The production well is then shut in and a predetermined amount of an oxygen-containing gas such as air, oxygen-enriched air, or essentially pure oxygen is injected into the steam swept zone via the injection well. The preferred amount of oxygen-containing gas injected is 0.5 to 1.5 MSCF of oxygen per barrel of resiual oil in the steam-swept zone. The injected oxygen-containing gas oxidizes residual oil in the steam-swept zone forming a viscous asphaltic material in that zone, thereby decreasing its permeability. Thereafter, steam is injected into the formation via the injection well and fluid incluing oil is recovered from the formation until the fluid recovered from the production well comprises an unfavorable amount of steam or water. After the initial steam injection step has been terminated upon steam breakthrough (or prior to steam breakthrough), production may be continued while simultaneously injecting the oxygen-containing gas but if this is done, the injection rate of the oxygen-containing gas is higher, preferably two to five times higher, than the injection rate if the production well is shut-in.

The process may be continued through repetitive cycles of injecting steam to a predetermined end point (which may be steam breakthrough at the production well or termination prior to steam breakthrough), followed by injection of the oxygen-containing gas for a predetermined period of time to plug the steam-swept zone, after which the injection of steam may be resumed.

THE DRAWINGS

In the accompanying drawings.

DETAILED DESCRIPTION

Figure 1:
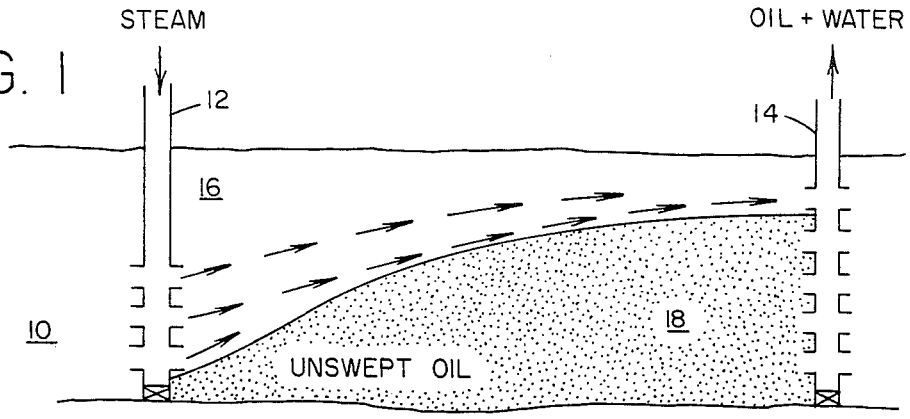
FIG. 1 illustrates a vertical plane section of a subterranean formation penetrated by an injection well and a production well, illustrating how initial injection of steam migrates to the upper portions of the formation.

The present process concerns an improvement in a steam flooding method of thermal oil recovery. The process is best understood by referring to the attached figures, in which FIG. 1 illustrates a viscous oil-containing formation 10 penetrated by an injection well 12 which is preferably in fluid communication with the lower one-third to one-half of the vertical thickness of the formation and a production well 14 which is preferably in fluid communication with essentially the full vertical thickness of the formation. Initially, steam is injected into the lower portion of the formation 10 through the injection well 12 and fluids including oil are produced from the formation through the production well 14. This step is continued until the fluid being recovered from the production well comprises a predetermined amount of steam or water or until steam breakthrough. In this step, steam enters the portion of the formation immediately adjacent to well 12 through all the perforations in well 12, and initially travels through substantially the lower one-third to one-half of the vertical thickness of formation 10. Because the specific gravity of vapor phase steam is significantly less than the specific gravity of other fluids, including the viscous oil present in the pore spaces of formation 10, steam vapor migrates in an upwards directiion, and, as can be seen in FIG. 1, the portion 16 of the formation 10 swept by steam vapor in the first step represents a decreasing portion of the vertical thickness of the formation as the steam travels between the injection well 12 and production well 14. Oil is recovered from the portion of the formation through which the steam vapor travels but there is a large portion of oil unrecovered from portion 18 of the formation through which little or no steam passes, thereby causing the total recovery efficiency to be very low.

Figure 2:
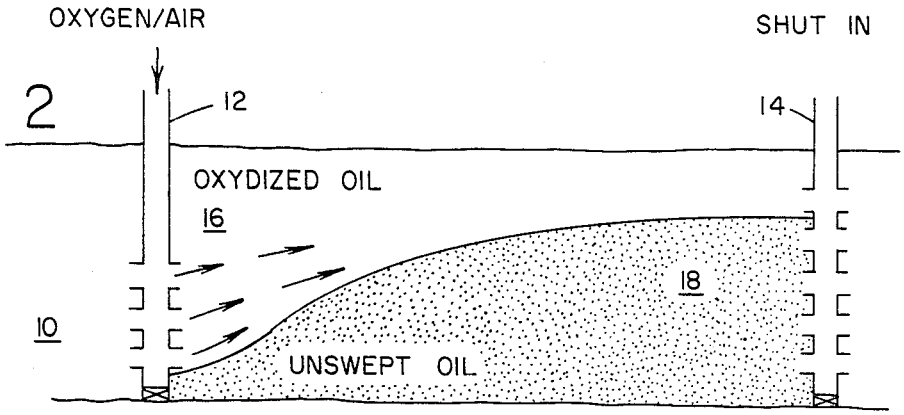
FIG. 2 illustrates the effect of injecting an oxygen-containing gas into the steam-swept zone to oxidize the residual oil to form a viscous asphaltic material.

In the second step of the process, once steam breakthrough occurs in well 14 or the fluid being recovered from the production well includes a predetermined amount of steam or water, an oxygen-containing gas such as air, oxygen-enriched air, or essentially pure oxygen is injected into the formation through injection well 12 as illustrated in FIG. 2. The amount of oxygen and the rate of injection will depend upon the characteristics of the formation such as viscosity of the oil, thickness of the formation, and the permeability of the formation.

Referring to FIG. 2, the injected oxygen-containing gas passes into the steam swept zone 16, and oxidizes the residual oil thereby increasing its viscosity and eventually causing the oil to solidify into an asphalt-type material that plugs the zone 16 originally swept by steam. Plugging of zone 16 will be determinable on the surface of the earth since the injection pressure will increase significantly as the viscosity of the oxidized residual oil rises.

Heavy oils contain a substantial amount of asphaltene. Upon oxidation, the asphaltenes content and the viscosity of the oil tend to increase. Given sufficient temperature and time of oxidation, the oil eventually solidifies into an asphalt-type material. For example, as disclosed in *Petroleum Refiner,* Vol. 38, No. 3, p. 198, Mar. 1959, 200 scf/minute of air was blown on 1 ton of asphaltic material at 500° F. for 2.5 hours. The resulting material was a solid with a softening point of 200° F. By blowing warm air to heavy oils trapped between rock matrices, Tervillinger et al reported in the Journal of Petroleum Technology, pp. 367–371, April 1964, that the rock permeability was reduced by as much as 50 percent. The reduction in permeability indicated solidification of the oil due to both oxidation and coking.

If the production well is shut in during the injection of the oxygen-containing gas, the amount of gas injected should be from 0.5 to 1.5 MSCF of oxygen per barrel of residual oil in the steam-swept zone of the formation in order to ensure proper plugging. The plugging effect may, however, be ensured by monitoring the injection pressure, with injection being terminated upon some predetermined increase in the injection pressure. However, if the production well is not shut in during this stage, the injection rate of the oxygen-containing gas should be higher, preferably two to five times higher than if the production well is shut in. At such increased injection rate, i.e. from 1.0 to 7.5 MSCF oxygen per barrel of residual oil, some residual oil will be oxidized while a small amount will be entrained into the injected gas stream and produced. A mixture of water, e.g. as steam, and the oxygen-containing gas may be used, e.g. at a ratio of free oxygen to steam of 70 to 210 SCF/BBL (cold water equivalent) or, the oxygen-containing gas may be used in the absence of added water during this stage of the operation.

After the oxygen-containing gas has been injected, injection of the oxygen-containing gas is terminated and additional steam injection is initiated and fluids including oil are recovered from the formation 10 via production well 14.

Figure 3:
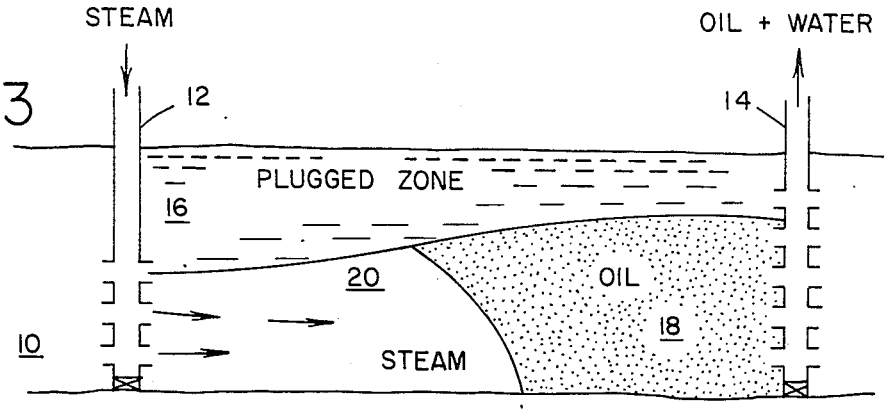
FIG. 3 illustrates the resumption of steam injection and how an additional vertical thickness of the formation is swept by steam after the previously steam-swept zone has been plugged.

In FIG. 3 it can be seen that the injected steam passes into zone 20 in lower portion of the formation below zone 16 which was essentially plugged by the oxidation of the residual oil, thereby increasing the vertical extent of the formation swept by steam injected through well 12. Steam injection and production of oil is continued until steam breakthrough occurs at the production well 14 or until the recovered fluids contain a predetermined amount of water or steam.

The process may be continued through repetitive cycles of injecting steam to a predetermined breakthrough at the producing well (or steam injection may be terminated prior to steam breakthrough), followed by injection of the oxygen-containing gas until the pore volumes previously swept by steam are largely plugged by oxidation of the residual oil. Repetitive cycles result in sweeping a very significant percentage of the formation, and can ultimately approach 100 percent volumetric displacement, although the economics of obtaining such effective displacement may require ending the oil recovery program prior to such a point.

If the oxygen containing gas is injected prior to steam breakthrough, plugging of the overriding zone or the channeling zones will occur at an early stage when the oil saturation remains high.

The present method is illustrated by the following Example utilizing a computer simulation study.

EXAMPLE

An injection well and a production well were set 650 feet apart into a reservoir with 120 feet of net pay. The areal dimension is equivalent to 3.24 acres. Other initial reservoir conditions are shown below:

| | |
|---|---|
| Oil Graviety | 13° API |
| Oil Viscosity | 1000 cp @ 120° F. |
| Reservoir Pressure | 300 psi |
| Reservoir Temperature | 120° F. |
| Porosity | 35% |
| Average Horizontal Permeability | 1.5 darcies |
| Vertical/Horizontal Permeability Ratio | 0.1 |

Steam was injected at 584 bbls (cold water equivalent) per day, or 1.5 bbls/day/ac-ft. A continuous steam flood until breakthrough at 750 days yielded 16 percent recovery of the original oil-in-place.

A second computer run was made in which the steam injection was stopped and air injection started at 200 days. At this time the top portion of the reservoir—the steam override zone was estimated to have a volume of about 16.4 acre-ft. Assuming a residual oil saturation of 40 percent and a temperature of 450° F. in this zone, it was calculated that about 4–5 MM scf of air was required for oxidizing each acre-ft of this swept zone. With an optimum injection rate of 150–300 M scf/day/ac-ft to prevent auto-ignition of the residual oil, the time for air injection was about 15–30 days. For computer simulation calculations, the permeability of this zone was arbitrarily reduced to 0.1 darcies to simulate the oxidation effect. The steam injection was then resumed and the breakthrough was delayed until 830 days at which time the recovery was 23 percent, significantly higher than the first case described above.

What is claimed is:

1. A method of recovering viscous oil from a subterranean, viscous oil-containing, permeable formation penetrated by an injection well which is in fluid communication with the lower one-third to one-half of the formation and a prouction well which is in fluid communication with a substantial portion of the formation, comprising:

(a) injecting steam into the formation through the injection well and recovering fluid including oil from the formation by the production well for a predetermined period of time, forming a steam-swept zone and an unswept zone in the formation;

(b) shutting in the production well;

(c) injecting an oxygen-containing gas into the steam swept zone through the injection well in an amount of 0.5 to 1.5 MSCF of oxygen per barrel of residual oil in the steam-swept zone, sufficient to oxidize residual oil in the steam-swept zone and sufficient to form a viscous asphaltic material in that zone, decreasing its permeability until the injection pressure increases; and (d) thereafter injecting steam only into the formation through the injection well and recovering fluid including oil from said unswept zone of the formation through the production well until the fluid recovered from the production well comprises an unfavorable amount of steam or water.

2. A method according to claim 1 in which the oxygen-containing gas is injected into the steam swept zone in the absence of added water.

3. A method according to claim 1 in which the oxygen-containing gas is air.

4. A method according to claim 1 wherein the oxygen-containing gas is essentially pure oxygen.

5. A method according to claim 1 in which step (a) is continued until the fluid being recovered from the production well includes a predetermined amount of steam or water.

6. A method according to claim 1 wherein the amount of the oxygen-containing gas injected during step (c) is about 0.5 to 1.5 MSCF of oxygen per barrel of residual oil in the steam-swept zone.

7. A method according to claim 1 in which steps (a) through (d) are repeated for a plurality of cycles.

8. A method of recovering viscous oil from a subterranean, viscous oil-containing, permeable formation penetrated by an injection well which is in fluid communication with the lower one-third to one-half of the formation and a production well which is in fluid communication with a substantial portion of the formation, comprising:

(a) injecting steam into the formation through the injection well and recovering fluid including oil from the formation by the production well to form a steam-swept zone and an unswept zone in the formation;

(b) continuing to recover fluid including oil from the formation through the production well and simultaneously injecting an oxygen-containing gas into the steam swept zone through the injection well to oxidize residual oil in the steam-swept zone and form a viscous asphaltic material in that zone, decreasing its permeability until the injection pressure increases; and (c) thereafter injecting steam only into the formation through the injection well and recovering fluid including oil from said unswept zone of the formation through the production well until the fluid recovered from the production well comprises an unfavorable amount of steam or water.

9. A method according to claim 8 in which the oxygen-containing gas is injected into the formation in the absence of added water.

10. A method according to claim 9 in which the amount of oxygen-containing gas injected into the formation is from 1.0 to 7.5 MSCF of oxygen per barrel of residual oil in the steam swept zone.

11. A method according to claim 8 in which the oxygen-containing gas is air.

12. A method according to claim 8 in which the oxygen-containing gas is oxygen-enriched air.

13. A method according to claim 8 in which the oxygen-containing gas is essentially pure oxygen.

14. A method according to claim 8 in which step (a) is continued until the fluid being recovered from the production well comprises a predetermined amount of steam or water.

15. A method according to claim 8 in which steps (a) through (c) are repeated for a plurality of cycles.

16. A method for recovering hydrocarbonaceous fluids from an unswept area of a viscous hydrocarbonaceous fluid bearing formation having a swept area therein where said swept area contains residual oil and where both areas are penetrated by an injection well which is in fluid communication with a spaced apart production well comprising:

(a) injecting steam into said formation through said injection well and recovering fluids including oil from said formation via said production well for a predetermined period of time from said swept zone;

(b) injecting simultaneously via said injection well an oxygen-containing gas into said swept zone in an amount sufficient to oxidize said residual oil in said swept zone for a time sufficient to form a viscous asphaltic material from said residual oil in said swept zone thereby decreasing its permeability causing an increase in the injection pressure;

(c) ceasing injection of said oxygen-containing gas and continuing injection of said steam; and (d) recovering fluids including hydrocarbonaceous fluids from said unswept area via said production well.

17. The method as recited in claim 16 where in step (a) steam injection is continued until said recovered fluids contain a predetermined amount of water or steam.

18. The method as recited in claim 16 where in step (a) steam injection is continued until steam break through occurs.

19. The method as recited in claim 16 where in step (b) said oxygen-enriched air is a member selected from the group consisting of air, oxygen-enriched air, and substantially pure oxygen.

20. The method as recited in claim 11 where in step (b) said production well is shut in during the injection of said oxygen-containing gas which is injected at about 0.5 to about 1.5 MSCF of oxygen per barrel of residual oil.

21. The method as recited in claim 16 where steps (a), (b), (c) and (d) are repeated until the pore volumes previously swept by steam are largely plugged by oxidation of residual oil.

* * * * *